US005251906A

United States Patent [19]

Heller et al.

[11] Patent Number: 5,251,906

[45] Date of Patent: Oct. 12, 1993

[54] FIREBALL AMUSEMENT GAME

[76] Inventors: Earl A. Heller, 16 Hopi Trail, R.D. 5, Box 17, Oak Ridge, N.J. 07438; William Alter, 904 Apache Rd., Franklin Lakes, N.J. 07427

[21] Appl. No.: 926,710

[22] Filed: Aug. 10, 1992

[51] Int. Cl.[5] ..... F41B 11/02; A63F 9/02

[52] U.S. Cl. ..... 273/397; 124/72; 124/82; 273/357

[58] Field of Search ..... 273/355-357, 273/349, 397, 30, 405; 124/72, 82

[56] References Cited

U.S. PATENT DOCUMENTS

| | | | |
|---|---|---|---|
| 1,489,191 | 4/1924 | Chester | 273/357 |
| 1,743,576 | 1/1930 | Smith | 124/72 |
| 1,929,327 | 10/1933 | Moray | 273/357 |
| 3,009,703 | 11/1961 | Jentsch et al. | 273/356 |
| 3,362,713 | 1/1968 | Miller | 273/349 |
| 3,572,712 | 3/1971 | Vick | 273/349 X |
| 3,802,705 | 4/1974 | Burns et al. | 273/357 |
| 3,911,888 | 10/1975 | Horvath | 273/30 |
| 4,002,336 | 1/1977 | Beaver et al. | 124/72 X |
| 4,215,867 | 8/1980 | Natwick | 273/357 |
| 4,770,153 | 9/1988 | Edelman | 124/72 |

FOREIGN PATENT DOCUMENTS

| | | | |
|---|---|---|---|
| 48907 | 7/1989 | Japan | 124/72 |
| 48910 | 10/1989 | Japan | 124/72 |

*Primary Examiner*—Paul E. Shapiro
*Attorney, Agent, or Firm*—Richard A. Joel

[57] ABSTRACT

A new and innovative game for the amusement industry comprises a gun which players use to guide a stream of balls to an intended target or objective. A revolving turntable feeds a plurality of balls one at a time into a tube where a motorized pinch wheel forces the balls up and through a tube to the gun. A blower is coupled to the tube to force the balls out of the tube end which is surrounded by a gun facade. The balls exit the tube end in a rapid stream which is directed at a target. A solenoid with a plunger mounted to the tube wall and movable within the tube is used to turn the gun on and off by halting the flow of balls.

7 Claims, 2 Drawing Sheets

FIREBALL AMUSEMENT GAME

BACKGROUND OF THE INVENTION

The design of the present game arose from the need to develop a new and different game which would provide tremendous action and excitement not only to playing patrons but also to those who are merely watching the game, thus adding to the entertainment experience. To provide the maximum appeal and interest while incorporating action and excitement, a shooting type game was designed. A rapid succession or "stream of balls" is fired from the gun and guided at their intended target thereby reducing the aiming that a player would need to compete in play.

The game is capable of shooting approximately 300–400 hollow plastic balls per minute per station. The balls are able to be reused and retained at a very high rate of speed under this system. The target design presents almost endless options which may be incorporated in the game play field. The design combination of turntable, pinch wheel, and air source have provided a new, innovative, and unique result in the form of a mechanically dependable, versatile and fast action game. The inventors are not aware of any relevant prior art despite their involvement with the field.

SUMMARY OF THE INVENTION

The present invention relates to a new and improved amusement game comprising a gun which fires a high velocity stream of balls at targets. The players guide the stream of balls at their intended target or objective located in the rear of the game. This reduces the amount of aiming and expands the group of possible players to younger age groups.

The invention includes a revolving turntable and associated drive means which lines up and feeds the recycled balls into a tube. The balls are then pushed up through a tube to the gun by a drive mechanism. A blower forces air at high velocity through the tube thereby ejecting the balls from the gun barrel. The rate of speed at which the balls are fired is controlled by the speed of the ball delivery system. The rate of speed of the balls, as well as the distance the balls travel, can be controlled or adjusted based upon the air rate of the blower. A solenoid located in the ball delivery tube adjusts the game's length of play by interrupting the flow through the tube.

Accordingly, an object of this invention is to provide a new and improved amusement game using a gun to hit targets with balls.

Another object of this invention is to provide a new and improved game apparatus wherein a stream of projectiles are directed at a target by a player.

A further object of this invention is to provide a new and improved coin operated amusement game wherein projectiles are fired at a high velocity at targets at the rear of the game.

A more specific object of this invention is to provide a new and improved amusement game wherein a stream of balls is fed from a turntable and driven through a tube wherein a blower forces the balls in a high velocity stream at targets.

BRIEF DESCRIPTION OF THE DRAWINGS

The above and other objects and advantages of the present invention may be more clearly seen when viewed in conjunction with following drawings wherein.

DETAILED DESCRIPTION OF THE INVENTION

Figure 1:
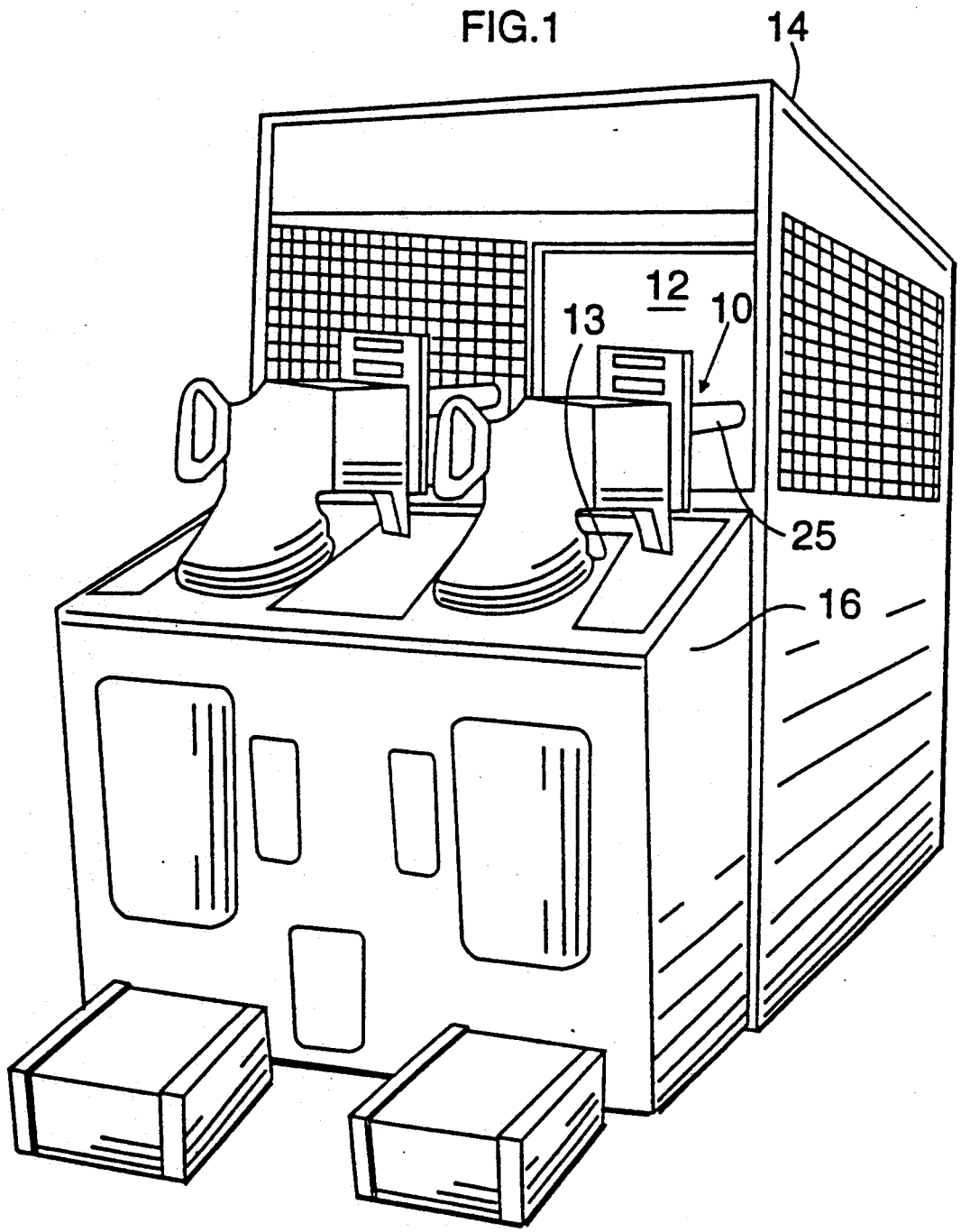
FIG. 1 is a schematic drawing illustrating the invention in the form of an amusement game; and, FIG. 2 is a schematic drawing illustrating the operation of the invention.

Referring now to the drawings, the invention comprises an amusement game of tremendous activity not only to playing patrons but also to those who merely wished to view the game in operation adding to the entertainment experience and serving as an enticement to play. The game includes a gun 10 which directs a stream of balls 11 at a high velocity of approximately 300–400 balls per minute at a variety of targets 12. The balls 11 which are propelled from the gun 10 in a rapid succession or stream are sufficient in quantity so that players are not required to aim the balls 11. Instead players guide a stream of balls 11 at their intended target reducing the skill level required and expanding the age group of potential players. As shown in FIG. 1, the invention comprises an amusement game known as FIREBALL TM. One or more guns 10 are mounted on a swivel 13 to move up or down or sideways to direct a stream of balls towards a target 12 in the rear of the game enclosure 14. The control system for the game is mounted within the compartment 16 and the lower portion of the game enclosure 14. A conventional coin slot 17 is provided to activate the game.

Figure 2:
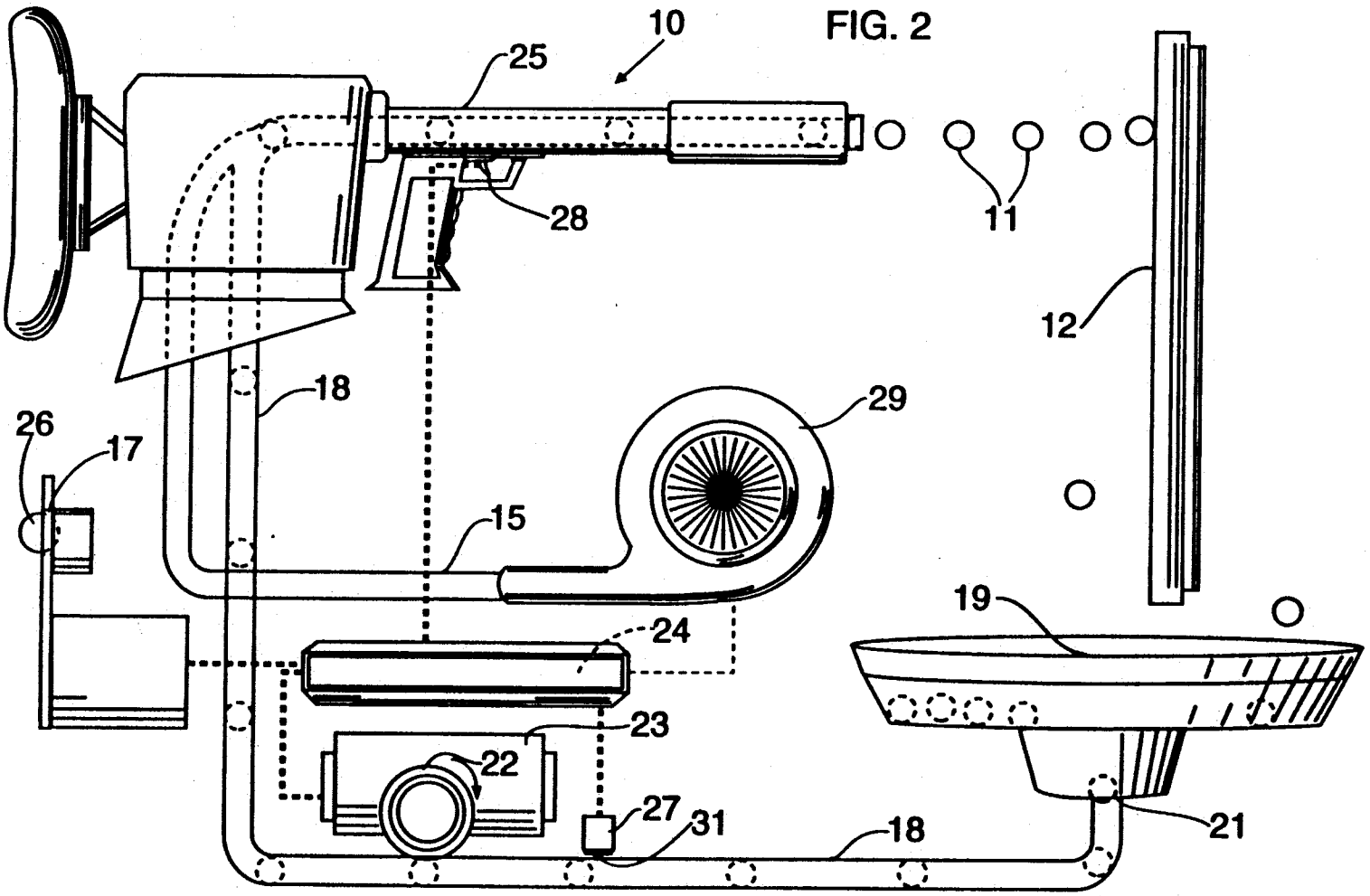

FIG. 2 illustrates the invention schematically and how it operates. The gun 10 is mounted over a tube 18 which is connected to a revolving turntable 19. The turntable 19 receives balls 11 which fall downwardly after striking the target 12 and dispenses the balls 11 one at a time through an outlet 21 into the tube 18. The balls are driven up and through the tube 18 by a pinch wheel 22 working off motor 23. The wheel 22 extends downwardly into the tube 18 to engage the balls 11 and push them along the tube 18 towards the gun 10.

A control module 24 is activated by a coin 26 which is deposited into the slot 17. The control system operates the pinch wheel motor 23, and the solenoid 27 when it receives various inputs from the trigger 28. Pressing the trigger activates the pinch wheel 22 and the blower 29 to force a stream of balls out of the gun 10. Releasing the trigger 28 operates the solenoid 27 which drives the plunger 31 into the tube 18 halting the flow of balls from the turntable 19.

Electronics are incorporated into the game to control start-up and shutdown, coin-up, sound, lighting, scoring, ticket redemption etc. The electronics are so designed to allow the operator complete versatility in his ability to control many features such as ticket payback, length of play time, cost per play volumes, scoring values, etc. Even items such as difficulty levels can be easily incorporated in the game electronics.

The ball delivery and propulsion system have many unique advantages. The rate of speed at which the balls are fired is controlled by the speed of the ball delivery system. This speed can be increased or decreased by changing the rate of rpm's that the pinch wheel 22 and/or the turntable 19 rotate. The blower 29 or air source control the speed of the balls 11 as well as the distance they travel. The blower 29 is connected to a send tube 15 which extends through an inlet in the stock 20 of the gun 10 and joins the tube 18 to drive the balls 11 out of the barrel 25. Increasing the blower rate will increase the velocity of the balls 11 as well as the distance they travel.

The solenoid 27, mounted to the ball delivery tube 18 provides the necessary versatility to adjust the length of play. The solenoid 27, when released allows the balls 11 to flow through the tube 18 and out through the gun 10. When operated, the solenoid plunger 31 extends into the tube 18 halting the flow of balls 11 and causing the gun 10 to cease firing. The solenoid 27 is activated either by releasing the trigger 28 or by a timer in the control module 24 when the game is over.

The game can easily be adapted and produced in a line game or group game embodiment for use primarily in amusement parks, theme parks, fairs, carnivals and the like. In this embodiment, two or more players would compete against one another and race to achieve the fastest or highest score or objective. The players would start from similar gun stations at the same time and the game would end when the first player reached an objective.

The rapid firing of balls 10 by the unique combination of turntable 19, pinch wheel 22 and air source 29 have provided a new, innovative and unique result in a fast action game wherein a mechanically dependable and versatile apparatus supplies a high delivery volume of balls with a unique propulsion system. The variations of targets, objectives and themes that can be incorporated in this apparatus are almost limitless.

While the invention has been explained by a detailed description of certain specific embodiments, it is understood that various modifications and substitutions can be made in any of them within the scope of the appended claims which are intended also to include equivalents of such embodiments.

What is claimed is:

1. An amusement game for shooting projectiles at a target comprises a gun having a stock including a first and second inlet, a barrel having an outlet aperture, and trigger means mounted thereto to activate the gun a first hollow tube having one end extending through the first gun inlet to the outlet barrel aperture a second hollow tube extending through the second gun inlet and being connected at one end to the first hollow tube within the gun a rotatable turntable having an open recessed upper portion to receive projectiles from the target and a lower portion having an opening, the other end of the first hollow tube being connected thereto to receive projectiles from the opening, a motor means and a pinch wheel driven thereby mounted in engagement with the first hollow tube to drive the projectiles through said tube to the gun, a blower connected to the other end of the second hollow tube to drive the projectiles out of the gun outlet at high speed; and control means activated by the trigger to operate the motor means for the pinch wheel and the blower to drive projectiles in a rapid stream from the gun outlet.

2. An amusement game in accordance with claim 1 further including:

a solenoid connected to the control means and mounted to the first tube, said solenoid having a plunger which extends into the first tube to halt the flow of projectiles when the trigger is released.

3. An amusement game in accordance with claim 2 further including:

coin actuating means coupled to the control means to activate the pinch wheel motor and blower and to deactivate the solenoid whereby a stream of projectiles can be fired from the gun upon pressing the trigger.

4. An amusement game in accordance with claim 1 wherein: the projectiles comprise hollow balls.

5. An amusement game in accordance with claim 1 wherein:

a second similar gun is mounted adjacent the first gun and the control means are coupled so that the gun which reaches a target score first is declared the winner.

6. An amusement game in accordance with claim 1 further including:

a target mounted above the turntable such that the projectiles hit the target and fall into the open recessed portion of the turntable.

7. An amusement game in accordance with claim 1 wherein:

the pinch wheel and the blower are adjustable to impart a predetermined velocity to the projectiles.

* * * * *